US005974912A

United States Patent [19]

Cheng et al.

[11] Patent Number: 5,974,912

[45] Date of Patent: Nov. 2, 1999

[54] DOOR LOCK UNLOCKABLE ELECTRO-MAGNETICALLY AND WITH A KEY

[76] Inventors: Tung-Chi Cheng, No. 48-1, Lane 300, Fu-Te Street; Jui-Hua Chang, No. 10, Alley 2, Lane 107, Shih-Tung Road, both of Taipei City, Taiwan

[21] Appl. No.: 09/190,290

[22] Filed: Nov. 13, 1998

[51] Int. Cl.[6] ..... E05B 13/10

[52] U.S. Cl. ..... 78/472; 70/223; 70/279.1; 70/422; 292/DIG. 27

[58] Field of Search ..... 70/221–224, 422, 70/472, 277, 278.1–278.7, 279.1, 280, 283, 283.1; 292/144, DIG. 27

[56] References Cited

U.S. PATENT DOCUMENTS

| | | | |
|---|---|---|---|
| 1,005,496 | 10/1911 | Armbruster | 292/DIG. 27 X |
| 1,447,754 | 3/1923 | Brabant | 70/223 |
| 1,787,591 | 1/1931 | Ottinger | 292/DIG. 27 X |
| 2,055,289 | 9/1936 | Hanan | 70/223 X |
| 2,497,329 | 2/1950 | Smith et al. | 292/DIG. 27 X |
| 2,729,090 | 1/1956 | Floraday | 70/223 |
| 3,922,896 | 12/1975 | Kagoura | 70/223 |
| 4,177,657 | 12/1979 | Aydin | 70/223 X |
| 5,010,752 | 4/1991 | Lin | 70/472 X |
| 5,421,178 | 6/1995 | Hamel et al. | 292/DIG. 27 X |
| 5,694,798 | 12/1997 | Nunez et al. | 70/224 X |
| 5,782,118 | 7/1998 | Chamberlain et al. | 70/283 X |

*Primary Examiner*—Lloyd A. Gall

[57] ABSTRACT

A door lock unlockable electro-magnetically and with a key consists of an inner plate, a control device, a drive mechanism, a housing, a handle and a locking mechanism. The control device has a control block engaging a post of the inner plate, and the control block has an outer end engageable with the drive mechanism. An IC key card can power the control device to unlock the door lock, and a key can also be used to rotate the locking mechanism for rotating the drive mechanism which moves inward to engage the control block of the control device. Then the handle can be rotated to rotate the shaft of a deadbolt to disengage from a deadbolt hole in a door frame to unlock the door lock for preventing from being unlocked by prying or breaking said lock mechanism illegally.

3 Claims, 5 Drawing Sheets

DOOR LOCK UNLOCKABLE ELECTRO-MAGNETICALLY AND WITH A KEY

BACKGROUND OF THE INVENTION

This invention relates to a door lock unlockable magnetically and with a key, particularly to one provided with both an electro-magnetic device for unlocking and a common lock structure able to be unlocked with a key, preventing the door lock from illegally pried open or broken open.

Common traditional door lock includes a locking means to be locked and unlocked with a key, and those door locks of mechanical structure may become not so smooth in locking and unlocking function due to loosened condition between the key and the locking means and tired resilience of springs, with pins unable to be moved, after a period of using. If worse, the key may not rotate the locking means. Further, some conventional door locks are made to be too complicated, causing difficulty in copying its key, and still may be pried open illegally.

SUMMARY OF THE INVENTION

This invention has been devised to offer a door lock unlockable electro-magnetically and with a key.

The main feature of the invention is a spring provided between a control device and a drive means. The drive means has an outer end portion formed with a plurality of projections spaced apart and a center threaded hole in the outer end portion. A handle has a center hole and a plurality of position grooves corresponding to the projections of the drive means to engage and disenage from. A locking means is contained in an outer portion of the center hole of the handle, having a threaded rod extending axially inward to engage the threaded hole of the drive means. Then an IC key card can be used to power the control device to push and compress the spring to move the drive means to let its projections engage the position grooves of the handle so that the handle can be rotated to rotate indirectly the shaft of the deadbolt, which is then disengaged from the deadbolt hole of a door frame, unlocking the door lock. Or a key can be used to unlock the door lock, by rotating the locking means to push the drive means to engage the control device so that the handle can be rotated to rotate the shaft of the deadbolt, which is then disengaged from the deadbolt hole of the door frame.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
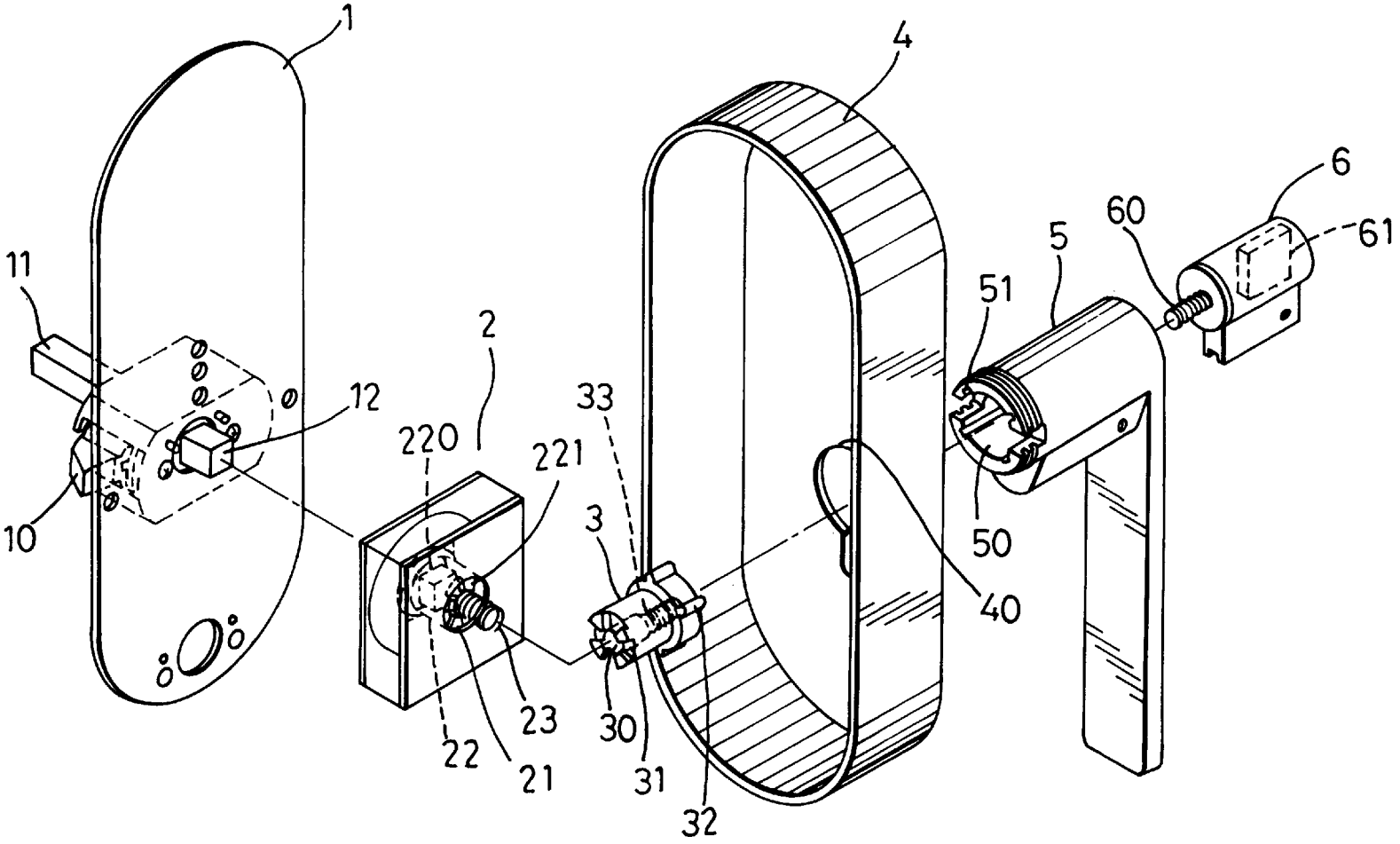
FIG. 1 is an exploded perspective view of a door lock unlockable electro-magnetically and with a key in the present invention.
Figure 2:
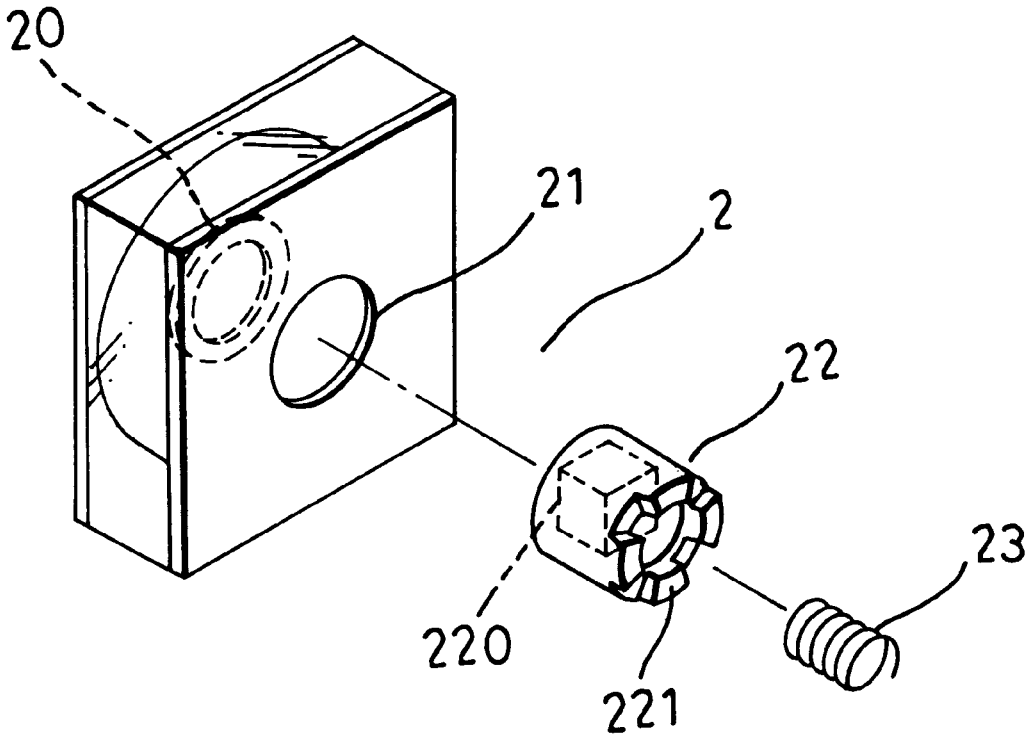
FIG. 2 is a control device in the present invention.

A preferred embodiment of a door lock unlockable electro-magnetically and with a key in the present invention, as shown in FIGS. 1 and 2, includes an inner plate 1 fixed on an inner side of a door, a control device 2, a drive means 3, a housing 4, a handle 5, a locking means 6 as main components.

The inner plate 1 has a deadbolt 10 to engage in a deadbolt hole in a door frame for locking the door, and a square shaft 11 extending axially to the inner plate 1 and a post 12 formed to extend axially and inward from the inner end of the square shaft 11.

The control device 2, as shown in FIG. 2, is fixed on the inner plate 1, shaped as a box, having a magnetic ring 20 fixed on an inner side of a front wall, a center hole 21 provided axially, a control block 22 fitted slidable in the center hole 21 within the distance between the front wall and a rear wall and having a square hole 220 formed in an inner portion to engage the post 12 of the inner plate 1 and a plurality of teeth 221 spaced apart on an outer annular end surface, and a spring 23 fixed in a center hole defines the outer annular end.

The drive means 3 is located to face against the control device 2, having a center hole 30 for an outer portion of the spring 23 half inserted in the outer portion of the control device 2 to fit therein, a plurality of tooth grooves 31 formed spaced apart in a front end surface to engage the teeth 221 of the control block 22 so that both, the control device 2 and the drive means 3 may be connected to each other and rotate together. Further, the drive means 3 has a plurality of projections 32 formed spaced apart on a circumferential end portion and a threaded hole 33 formed in a rear portion.

The housing 4 is fixed on the outer side of the door in the corresponding location of the inner plate 1, having a hole 40 in a vertical side.

The L-shaped handle 5 is combined with the housing 4 with its horizontal cylinder portion, having a center hole 50 in a front portion of the cylinder portion for the drive means 3 to fit partly therein, a plurality of position grooves 51 spaced apart in an inner wall of the center hole 50 to engage and disengage from the projections 32 of the drive means 3 so as to enable the drive means 3 move axially in the center hole 50.

The locking means 6 is contained in an outer portion of the center hole 50 of the handle 5, and fixed tightly with the handle 5 with screws, having a drive threaded rod 60 extending axially outward from an inner side and screwing with the threaded hole 33 of the drive means 3, and a key hole 61 for a key to insert therein for locking and unlocking.

Figure 3:
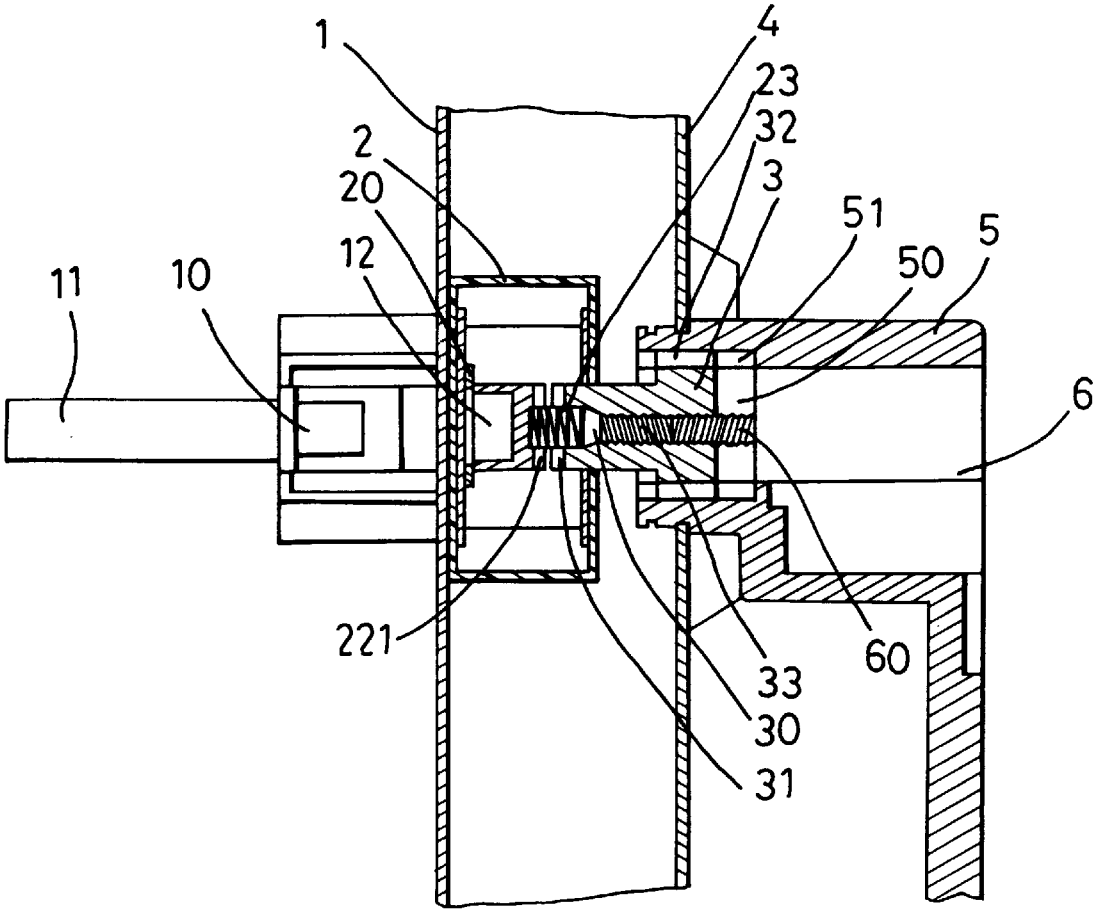
FIG. 3 is a cross-sectional view of the door lock unlockable electro-magnetically and with a key in the present invention, showing it being in a locked condition.

After the door lock is assembled as described above, referring to FIGS. 1, 3, 4 and 5, so long as the control device 2 is not powered, the control device 2 is pushed automatically by the spring 23, with the teeth 221 disengaging from the teeth grooves 31 of the drive means 3, with the control device 2 disengaging from the drive means 3. Thus, the shaft 11 is in an idle rotating position, impossible to be rotated by the handle 5, as shown in FIG. 3, that means, the door lock is in the locked condition.

Figure 4:
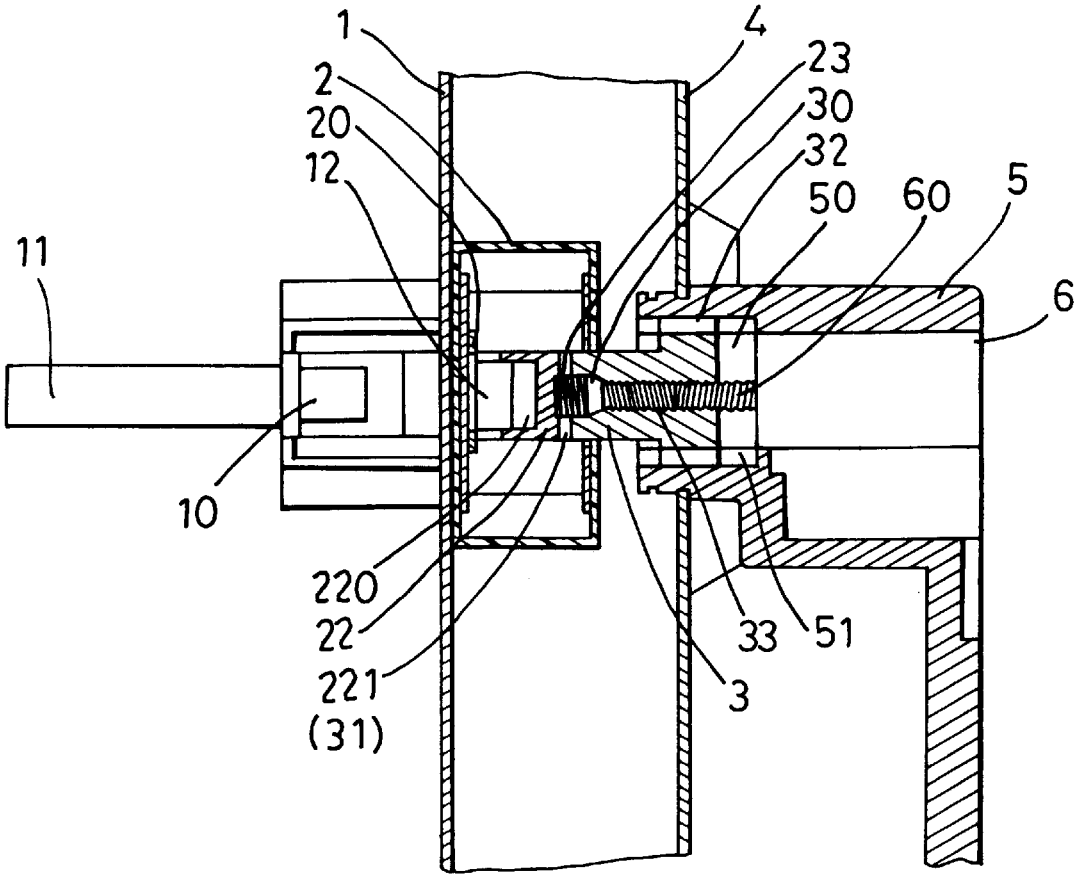
FIG. 4 is a cross-sectional view of the door lock unlocked by using an IC key card in the present invention; and, FIG. 5 is a cross-sectional view of the door lock unlocked by using a key in the present invention.

If an IC key card is slide in a card passageway of the door lock, then the control device 2 is powered to force the magnetic ring 20 to push the drive block 22 outward to compress the spring 23, which then moves toward the drive block 3, forcing the teeth 221 of the control device 2 to engage the tooth grooves 31 of the drive means 3, as shown in FIG. 4. Consequently, a part of the square hole 220 of the control device 2 still engages the post 12 of the inner plate 1, with the teeth 221 engaging the tooth grooves 31, the projections 32 of the drive means 3 engaging the position grooves 51 of the handle 5. Then the handle 5 can be rotated to rotate indirectly the shaft 11 to disengage the deadbolt 10 from the deadbolt hole of the door frame, unlocking the door lock.

Figure 5:
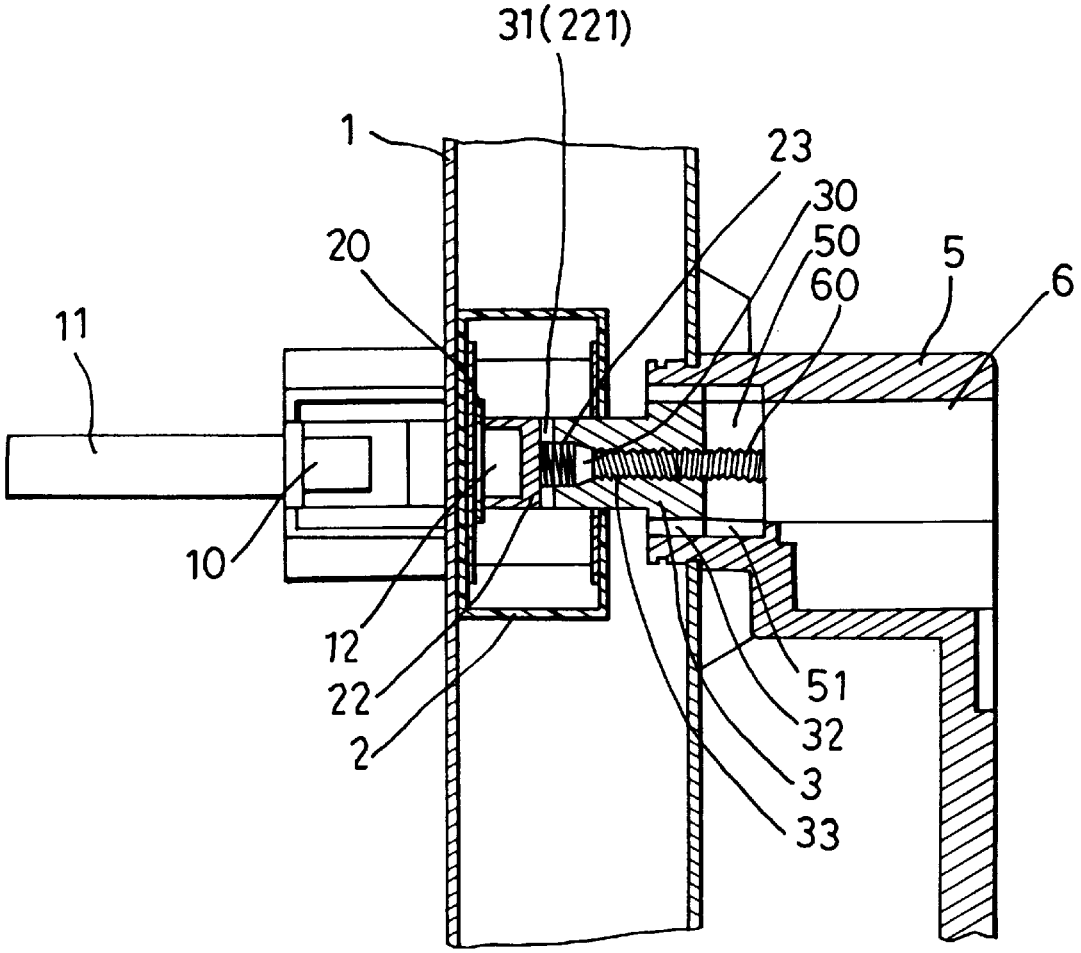

If a key is used for unlocking the door lock, as shown in FIG. 5, the key is inserted in the key hole 61 of the locking means 6 and rotated to rotate the drive rod 60 for three rounds or so, pushing the drive means 3 move toward the control block 22, compressing the spring 23 and forcing the tooth grooves 31 to engage the teeth 221. Then the handle 5 can be rotated to rotate the drive means 3, the control device 2 and then the shaft orderly to disengage the deadbolt 10 from the deadbolt hole in the door frame. Thus the door is unlocked by using the key as in the same way as the IC key card does.

The door lock in the present invention has the following advantages, as can be seen from the aforesaid description.

1. It has two methods of unlocking, an electro-magnetic way and a key way.

2. If the teeth of the control block of the control device do not engage the tooth grooves of the drive means, the handle can only be rotated idle, unable to rotate the shaft, preventing the door lock from locked by children playing the door lock or being pried or broken illegally. And the deadbolt is never pried open as conventional door locks can.

3. The unlocking way of using an IC key card is better for protecting the door lock, not liable to be copied.

While the preferred embodiment of the invention has been described above, it will be recognized and understood that various modifications may be made therein and the appended claims are intended to cover all such modifications which may fall within the spirit and scope of the invention.

What is claimed is:

1. A door lock unlockable electro-magnetically and with a key comprising:

an inner plate fixed on an inner side of a door, having a deadbolt, a shaft extending axially, and a post formed to extend inward from an inner end of said shaft;

a control device shaped as a box, fixed on an outer side of said inner plate, having a center hole formed in an outer side wall, a ring fixed on an inner side wall, a control block having a square hole formed in an inner portion to engage said post of said inner plate and a plurality of teeth formed spaced apart on an outer end surface;

a drive means facing against said control device, having a plurality of tooth grooves in an inner end surface to correspond to said teeth of said control block of said control device;

a housing fixed on an outer side of the door to face against said inner plate, containing said control device and said drive means, having a hole in a vertical side;

an L-shaped handle having a cylindrical portion and a vertical grip portion, combined with said housing, said cylindrical portion having a center hole for said drive means to fit movable therein;

a locking means fixed in an outer portion of said center hole of said handle, having a key hole;

characterized by a spring placed between said control block of said control device and said drive means, said control block being slidably engageable with said drive means and said drive means having a plurality of projections spaced apart on an outer end portion and a threaded hole formed in said outer end portion; said center hole of said handle having a plurality of position grooves corresponding to said projections of said drive means; said locking means having a threaded drive rod extending axially inward from an inner end to engage said threaded hole of said drive means.

2. The door lock unlockable electro-magnetically and with a key as claimed in claim 1, wherein said control block of said control device is limited to move in said center hole within the distance between a front wall and a rear wall.

3. The door lock unlockable electro-magnetically and with a key as claimed in claim 1, wherein said locking means is contained in an outer portion of said center hole of said handle and fixed tightly with said handle.

* * * * *